United States Patent [19]

Strachan

[11] 3,940,917

[45] Mar. 2, 1976

[54] COMPOSITE ELASTIC YARNS AND PROCESS FOR PRODUCING THEM

[75] Inventor: Donald Rittler Strachan, Martinsville, Va.

[73] Assignee: E. I. Du Pont de Nemours and Company, Wilmington, Del.

[22] Filed: Sept. 5, 1974

[21] Appl. No.: 503,500

[52] U.S. Cl. ..... 57/152; 28/72.12; 57/140 BY; 57/157 F

[51] Int. Cl.[2] ..... D02G 3/32; D02J 1/08

[58] Field of Search..... 57/34 P, 157 F, 152, 163, 57/140 BY; 28/1.4, 72.12

[56] References Cited

UNITED STATES PATENTS

| | | | |
|---|---|---|---|
| 2,985,995 | 5/1961 | Bunting, Jr. et al. | 57/140 R |
| 3,013,379 | 12/1961 | Breen | 57/157 F |
| 3,078,654 | 2/1963 | Marshall | 57/163 |
| 3,501,819 | 3/1970 | Satterwhite | 57/157 F X |
| 3,540,204 | 11/1970 | Tanaka et al. | 57/163 |
| 3,807,162 | 4/1974 | Tsujita et al. | 57/152 |

FOREIGN PATENTS OR APPLICATIONS

| | | |
|---|---|---|
| 40-21496 | 9/1965 | Japan |

*Primary Examiner*—John Petrakes

[57] ABSTRACT

A composite yarn, which is bulky when relaxed and elongates to at least 100 percent greater length under tension, with quick recovery of the relaxed condition when tension is removed, is composed of uncrimped elastic yarn and at least five relatively inelastic continuous filaments entangled about the elastic yarn to provide protection and desirable textile properties. The composite yarn can be made at unusually high speeds by entangling the relatively inelastic filaments about stretched elastic yarn with jets of high velocity fluid impinged at an angle of 90°±45° to the yarn axis, using a filament feed rate which avoids formation of filament loops in the stretched yarn. Examples illustrate combining spandex elastic yarn at 4X stretch with nylon filaments at zero percent overfeed, when using feed rates of up to 789 yards per minute.

16 Claims, 9 Drawing Figures

COMPOSITE ELASTIC YARNS AND PROCESS FOR PRODUCING THEM

BACKGROUND OF THE INVENTION

This invention relates to composite elastic yarns and a process for making them. The invention is more particularly concerned with a composite of relatively inelastic filaments entangled around spandex elastic yarn or other highly elastic yarn.

Elastic yarns for textile use are usually covered with relatively inelastic filaments which may be any of the synthetic filaments commonly used for textile purposes. When used in combination with elastic yarns, such filaments may be designated as "hard fibers." The hard fibers are used to protect the elastic yarn from abrasion, to provide strength at the maximum useful extension of the composite yarn so that the elastic yarn will not be broken, and to provide lower running friction properties to improve the performance of the composite yarn in knitting or weaving operations. The hard fibers also make possible the production of fabrics having the appearance and feel of fabrics knitted or woven from conventional inelastic yarns.

The most common method of producing such composite yarns is to twist one or more yarns of hard fibers about the elastic yarn while the elastic yarn is extended to about the maximum extent desired for use in the final fabric. When one or more covering yarns are wrapped spirally in a single direction about an elastic yarn, the composite yarn is called a "single covered" elastic yarn. Such composite yarns have torque due to the unidirectional twist. When additional yarn or yarns are also wrapped around the composite yarn with opposite direction of twist, the result is called a "double covered" elastic yarn. Since a large number of spiral turns per yard of yarn are required for adequate covering of the elastic yarn, and the wrapping operation is slow, production of single or double covered elastic yarn is costly.

Composite yarns can be produced at higher speeds by false twisting a covering of hard fibers about an elastic yarn and heat setting the false twist in the hard fibers. A relatively loose covering of hard fibers having a reversing helical crimp can be produced in this way. Objectionable slippage of the covering over the elastic yarn can be avoided if the heat-setting treatment is performed at a temperature which causes portions of the hard fibers to adhere to the elastic yarn. However, heat-treatment of the elastic yarn is undesirable because it causes a serious reduction in elastic stretch properties.

Hard fiber coverings have also been applied to elastic yarns with bulking jets as disclosed in Marshall U.S. Pat. No. 3,078,654, Breen U.S. Pat. No. 3,013,379 and Miyasaka Japanese Application Pulication 40-21496/1965. Bulk is provided by crunodal or other loops which project from the surface even when the composite yarn is stretched to the maximum useful extension of the yarn. Projecting loops are undesirable when the composite yarn is extended under tensions used in knitting or weaving because the loops interfere with processing the yarn into fabric.

The present invention provides important improvements with respect to the above-mentioned problems. Other advantages of the invention will become apparent from the specification, drawings and claims.

SUMMARY OF THE INVENTION

The composite yarn of the present invention comprises uncrimped elastic yarn and at least five relatively inelastic filaments (hard fibers) to protect the elastic yarn and provide desirable textile properties. The relaxed composite yarn is bulky and is capable of being extended at least 100 percent in length when stretched until the relatively inelastic filaments first become load-bearing. When stretched until the hard fibers first become load-bearing, the composite yarn is characterized by load-bearing, relatively inelastic filaments entangled tightly around the elastic yarn in intermittent zones of random braided structure and otherwise extending substantially parallel to the elastic yarn, there being an average entanglement spacing of less than 10 centimeters and the filaments being free from crunodal or other surface loops when the composite yarn is examined in the stretched condition as described subsequently.

The composite yarn preferably has substantially zero unidirectional torque. The relatively inelastic filaments preferably have crimp when relaxed. The crimp is preferably such that the relatively inelastic filaments form loops and twist pigtails when the composite yarn is relaxed. In accordance with a preferred embodiment, the relatively inelastic filaments form reversing helical coils when the composite yarn is relaxed. The relatively inelastic filaments may be bicomponent filaments which crimp when relaxed.

The elastic yarn may be of any type having a break elongation greater than 100 percent, but is preferably a coalesced spandex elastic yarn having a break elongation greater than 200 percent. The elastic yarn may be composed of a plurality of separately-coalesced spandex elastic yarns. The composite yarn preferably has a break elongation of 200 to 400 percent. Preferred embodiments of composite yarn have an average entanglement coherency of less than 5 centimeters in the test described subsequently. The elastic portion of the composite yarn shows no evidence of crimp, twist or torque produced by the operation of combining the hard fiber filaments with the elastic yarn.

The composite yarn of this invention can be produced at feed rates of up to 800 yards per minute, or higher, by continuously feeding the elastic yarn with the relatively inelastic filaments through jetted high velocity fluid and impinging the jetted fluid on the yarn axis at an angle of 90° ± 45° to entangle the filaments tightly around the elastic yarn in intermittent zones of random braided structure. The elastic yarn is fed to the jetted fluid under tension sufficient to extend the yarn to at least 100 percent greater length than its relaxed length. The relatively inelastic filaments (hard fibers) are simultaneously fed at a rate which provides between 2 percent net underfeed and 2 percent net overfeed to the jetted fluid. Preferably the composite yarn is wound on a package with the hard fiber filaments under tension.

Suitable hard fiber filaments include any synthetic textile filaments of relatively inelastic material such as nylon, polyester, polypropylene, cellulose acetate, regenerated cellulose, etc. The hard fiber filaments may be fed to the jetted fluid as a bundle of at least five filaments and may be of more than one material. The bundle preferably has less than ½ turn per inch of twist and the filaments must be capable of being separated by the jetted fluid.

The elastic yarn must have a break elongation greater than 100 percent. It may be a monofilament or coalesced multifilaments, and may be two or more filaments which can be separated at least temporarily by the jetted fluid. Preferably the elastic yarn is composed of coalesced spandex elastic yarn having a break elongation of greater than 200 percent and the yarn is fed under tension sufficient to extend the yarn to at least 200 percent greater length than its relaxed length. Preferably the elastic yarn is composed of a plurality of separately-coalesced spandex elastic yarns and the jetted fluid is impinged on the yarn to insert portions of the relatively inelastic filaments between the spandex yarns, in addition to entangling the filaments around the elastic yarn.

The fluid used is preferably compressed air, although other fluids can be used; it is usually at ambient temperature. The fluid is preferably impinged on the yarn from more than one direction, each substantially perpendicular to the yarn axis.

DETAILED DESCRIPTION

Figure 1:
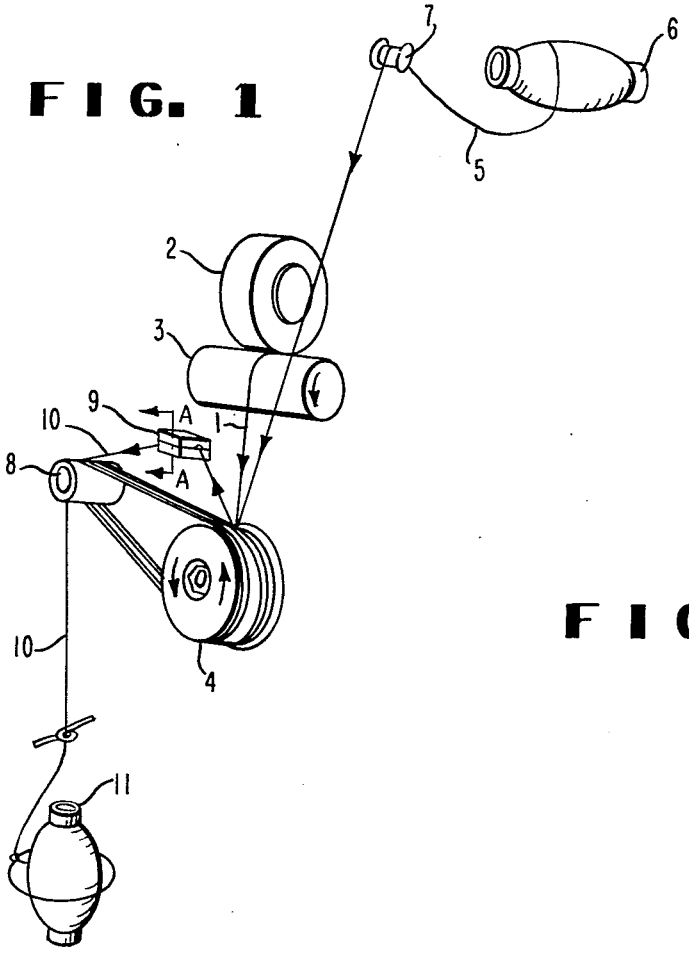
FIG. 1 is a schematic representation of a process for entangling a hard fiber yarn about an elastic yarn and winding up the product.

In FIG. 1, elastic yarn 1 is fed from package 2 which preferably rests on and is rotated by driven feed roll 3. Driven roll 4 is rotated at a higher rate of speed than feed roll 3, the difference in speeds being determined by the desired degree of stretch to be imposed on the elastic yarn. Multifilament hard fiber yarn 5 is drawn from package 6 by the rotation of roll 4. Yarn 5 may be wrapped on guide 7 to establish pre-tension or one of the common tensioning devices may be substituted at no. 7. Alternatively, yarn 5 may be fed to roll 4 by a positively driven feed roll. At roll 4, elastic yarn 1 and hard fiber yarn 5 are guided together in parallel in one or more wraps between powered roll 4 and freely rotating roll 8. The yarns then pass through fluid entangling jet 9 which may have yarn guides at the entrance and exit to center the yarns within jet 9 which entangles the hard fiber filaments about the elastic yarn. The resulting composite yarn 10 then passes in one or more wraps about rolls 4 and 8 and thence to a windup device which may be a ring and traveler, feeding the yarn onto windup package 11, the windup often inserting a low degree of twist, e.g., one turn per inch or less. Alternatively, package 11 may be cross wound without twist.

Figure 2:
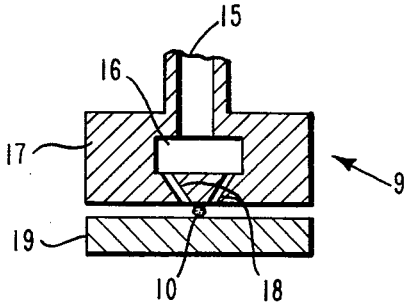
FIG. 2 is an enlarged cross-sectional view of entangling jet 9 of FIG. 1.

In FIG. 2, a fluid jet entangling device of Bunting et al. U.S. Pat. No. 3,115,691 is shown in cross section along the lines A—A of FIG. 1. In FIG. 2, compressed air is supplied from a source (not shown) through pipe 15 to plenum chamber 16 within jet body 17 and thence through two fluid conduits 18 to impinge on the elastic and multifilament covering yarns and entangle the covering filaments about the elastic yarn forming composite yarn 10. Wall 19 is supported at a fixed distance from body 17 and confines the air from orifices 18 within the region around the yarns to intensify the entangling action.

Figure 3:
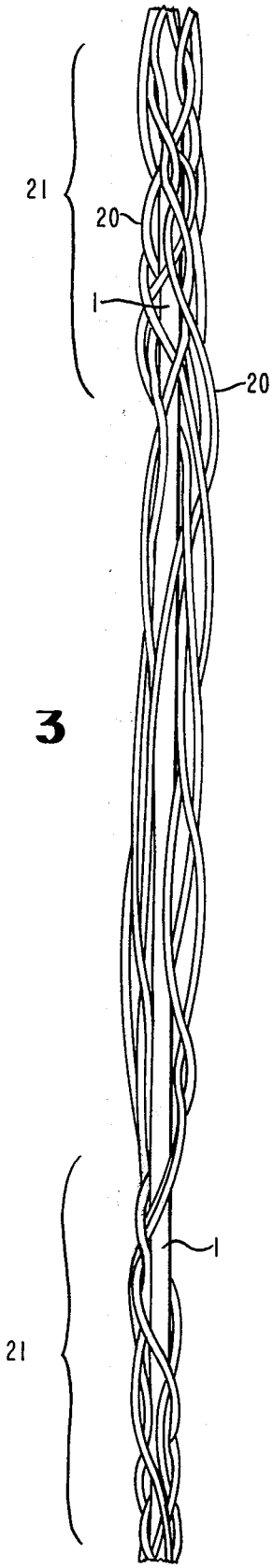
FIG. 3 illustrates a yarn of this invention when held at the tension under which it is entangled and wound on a paekage.

FIG. 3 shows a yarn of this invention in which hard fiber filaments 20 are shown entangled with other hard fiber filaments about elastic yarn 1, which in this case is a single yarn of coalesced spandex. The entanglement is predominantly concentrated at random braided zones 21 spaced periodically along the length of the yarn. In between random braided zones 21, the hard fiber filaments 20 are distributed about elastic yarn 1 so as to minimize contact between elastic yarn 1 and guide surfaces, for example, but are not necessarily entangled about it.

Figure 4:
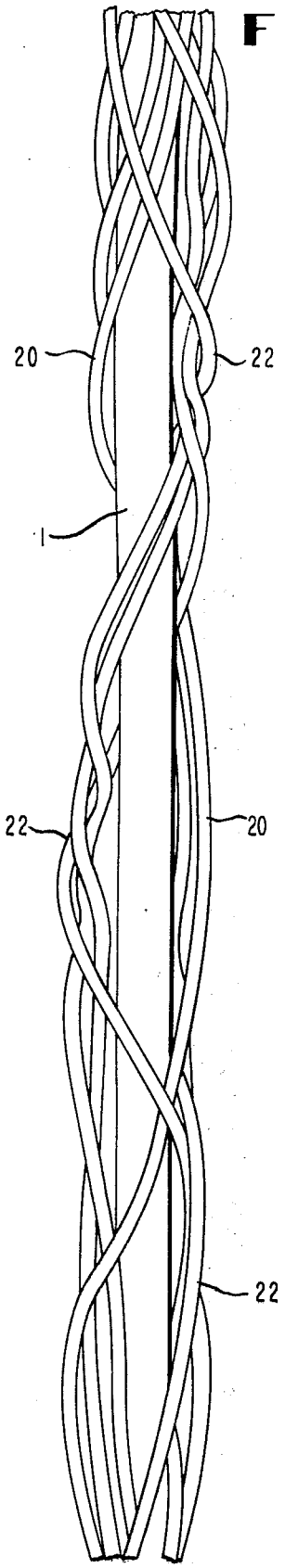
FIG. 4 illustrates, at greater magnification, a highly entangled random-braided zone of the yarn of FIG. 3.

FIG. 4 is a closer view of one random braided zone 21 of FIG. 3. Hard fiber filaments 20 surround elastic yarn 1 and are entangled with other filaments 20 at locations such as 22. Even though filaments 20 of this particular yarn are false twist textured, they do not exhibit coils or loops at this stage because they are tensioned.

Figure 5:
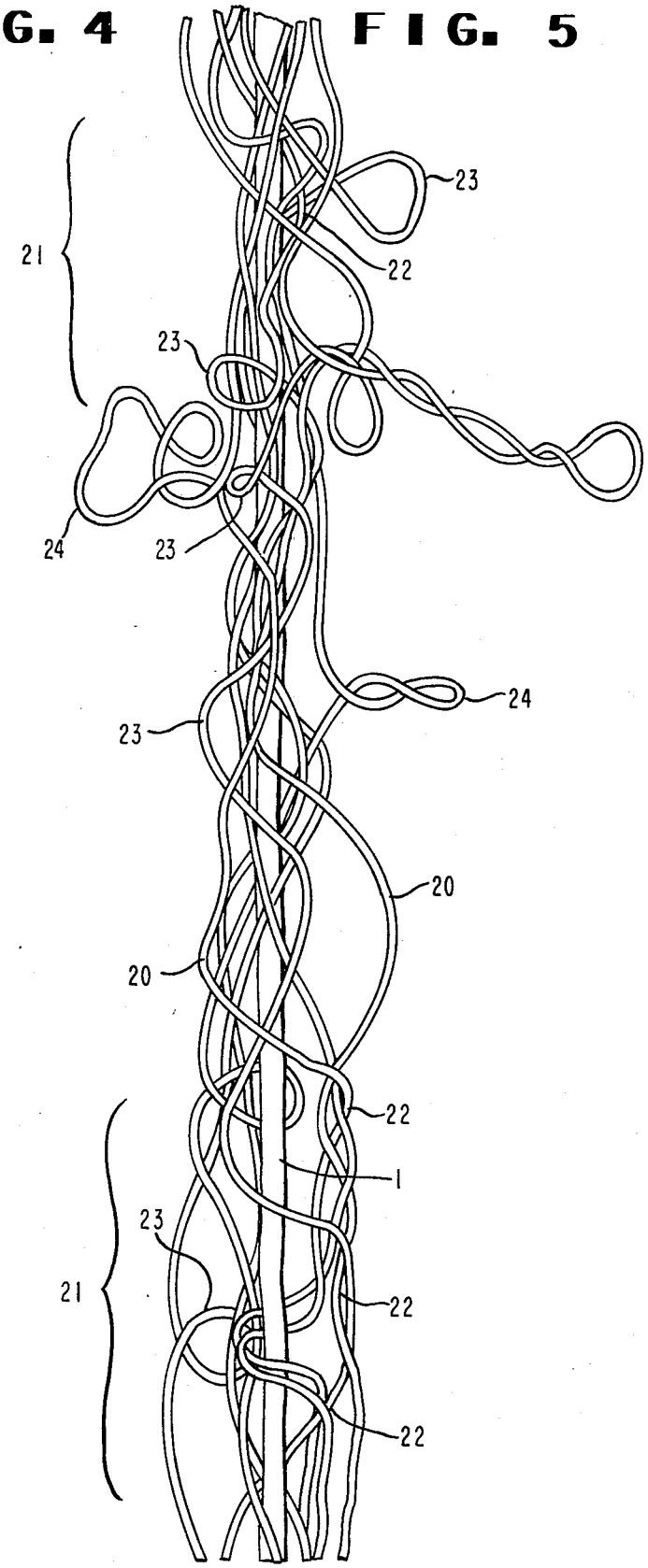
FIG. 5 illustrates the yarn of FIGS. 3 and 4 when partially relaxed.

FIG. 5 shows the yarn of FIGS. 3 and 4 relaxed to about half of its fully-extended length. The portions of filaments in between random braided zones 21 are free to form loops 23 and twist pigtails 24. Even in random braided zones 21 the shortening of the composite yarn allows filaments 20 to move substantially away from elastic yarn 1 and to form loops. Since not all filaments are equally entanged in zones 21, those which are less entangled are free to form twist pigtails 24. Entanglements can be seen at 22.

Figure 6:
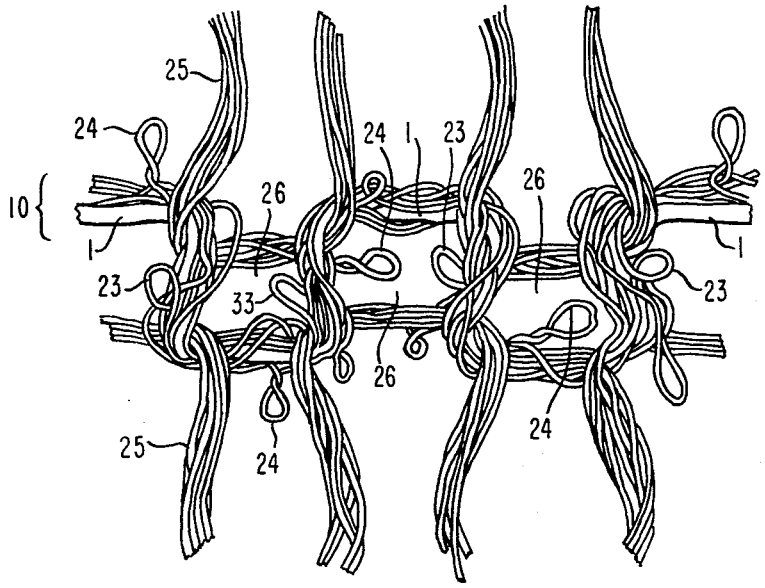
FIG. 6 illustrates a circular knit fabric made from a yarn of this invention in which the multifilament hard fiber yarn is a false-twist textured stretch yarn.

FIG. 6 shows a hosiery fabric knit from a yarn of FIGS. 3 and 4. The fabric has been finished under hot relaxed conditions, allowing filament loops and twist pigtails to develop. The fabric is shown partially extended, approximately as it would be during wear. Courses of composite yarn 10 alternate with courses of ordinary nylon 25. The knit stitches of course of composite yarn 10 are approximately the same size as the stitches of ordinary nylon 25 when formed, but the contraction of elastic yarn 1 provides desired elasticity in the fabric. Loops 23 protrude from the surface of composite yarn 10 and partially obscure openings 26 between stitches, thus contributing opacity or covering power. Twist pigtails 24 not only contribute opacity but also extend out of the plane of the fabric, giving spun-like tactile aesthetics.

Figure 7:
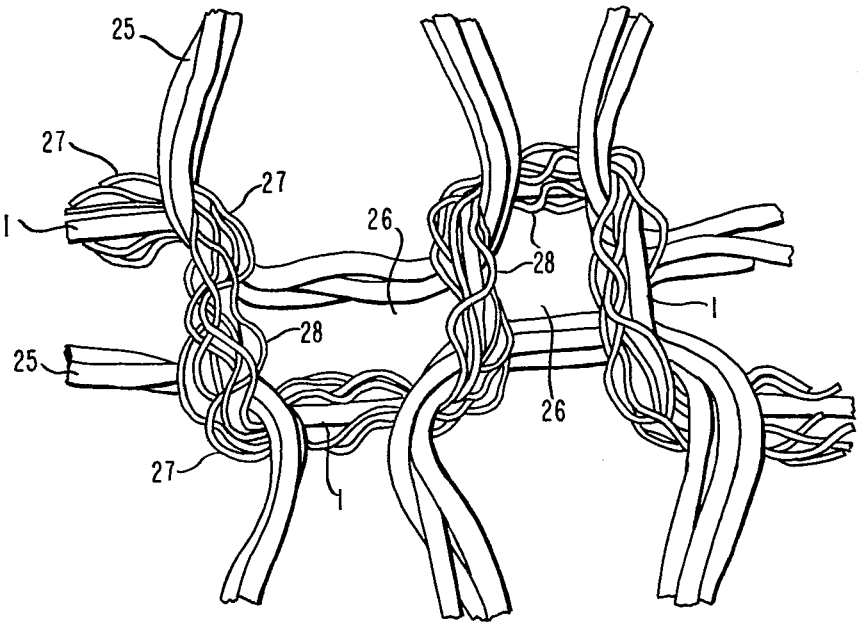
FIG. 7 illustrates a fabric knit from a yarn of this invention in which the multifilament hard fiber yarn is a bicomponent.

FIG. 7 is a hosiery fabric similar to that of FIG. 6 except that hard fiber filaments 27 are bicomponent. These filaments are essentially straight at the time they pass through fluid entangling jet 9 but when the fabric is finished, the differential shrinkage between the constituents of the bicomponent filaments cause them to form periodically reversing coils 28 in the nature of small tension springs. Thus, filaments 27 remain in close contact with elastic yarn 1. The spring-like nature of such coils allows the composite yarn to stretch and relax in use while keeping the filaments 27 close to elastic yarn 1 and not obscuring openings 26. This is useful in the leg portion of pantyhose where opacity and spun-like tactile aesthetics are undesirable.

Figure 8:
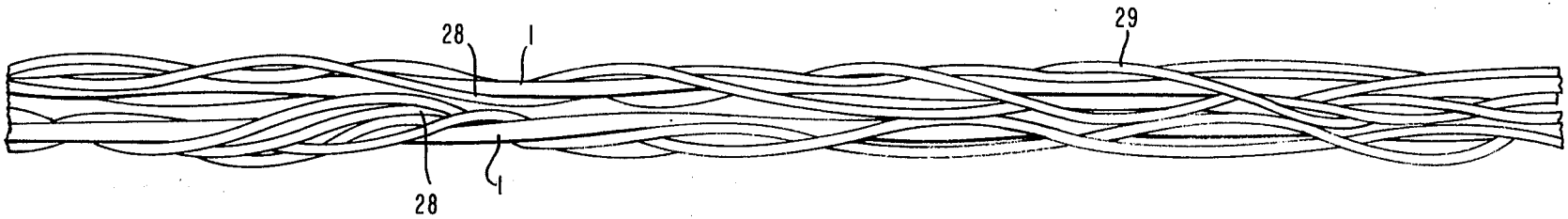
FIG. 8 illustrates a tensioned yarn of this invention wherein two elastic yarns are employed.

FIG. 8 shows a random braided zone of a tensioned yarn of this invention having a two-filament elastic yarn 1. Hard fiber filaments such as 28 pass between elastic yarns 1 and may be entangled around each of elastic yarns 1 individually while other hard fiber filaments such as 29 are entangled around both elastic yarns 1.

PROCESS

Elastic yarn 1 may be a single strand of rubber or, in the case of spandex, may be a single end consisting of filaments which have been coalesced at the spinning operation so that they are substantially inseparable during the entangling operation of this invention. Elastic yarn 1 may also be two or more individual strands, and they may be taken from individual packages or they may be unwound in parallel from a single package. For certain purposes, uncoalesced spandex filaments may be employed. Alternatively, elastic filaments or groups of filaments may be lightly coalesced so that the fluid forces encountered in the entangling process may separate the filaments intermittently or completely, or the filaments may be coalesced intermittently along their lengths, providing intermittent spaces for hard filaments to be inserted between the elastic filaments while maintaining substantial coherency between the elastic components.

The elastic yarn or yarns may be stretched between rolls 3 and 4 up to nearly the elastic limit of the yarn, e.g., a stretch of 150%, 200%, 300%, 400%, 500% or higher, depending on the yarn. The exact degree of stretch is determined by the amount of retraction desired in the final yarn. Normally, a suitable degree of stretch would be approximately 50% to 90% of the ultimate break elongation of the elastic yarn.

The hard fiber multifilaments 5 consist of relatively inelastic continuous filaments of any commonly available textile material. Nylon is generally preferred because of its high strength and low friction. Either uncrimped or crimped yarn may be employed, but crimped or crimpable yarns must be capable of being held loop-free at the tension required to entangle the filaments around the core and wind the composite yarn on a package. Tension-stable textured yaran of Breen U.S. Pat. NO. 2,783,609, for example, which has crunodal surface loops when held at tension, is unsatisfactory for the purpose of the present invention. Two or more different multifilament yarns may be employed, for example, nylon to give strength at ultimate extension and cellulose acetate to provide luxurious tactile aesthetics when the fabric is relaxed. Two yarns having differential shrinkage properties may be employed for certain effects. For example, an untextured polyester yarn having high potential shrinkage may be fed with a textured nylon yarn and be entangled around an elastic core yarn wherein both hard fiber yarns are at the same tension during entangling and, in contrast to those of Breen above, remain loop free when wound on the package. When such yarn is made into fabric, and the fabric is heat treated under relaxed conditions, the polyester will shrink while the nylon develops crimp. When the treated fabric is then stretched, the polyester will become the load-bearing member to limit the ultimate extension of the composite yarn and will permit the textured nylon to retain a degree of crimp and bulk even at ultimate extension of the composite.

When the hard fiber component of the present composite yarn is crimped or crimpable, the retractive power of such yarn may be less than that normally required when these filaments are used alone, since the elastic portion of the present composite yarn furnishes the major retractive power of the composite. The hard fiber filaments, therefore, need only have sufficient crimping ability to form the crimps, twists, or coils desired for imparting bulk, opacity or tactile aesthetics to the final fabric. These filaments may, therefore, be processed at higher speeds or under less stringent texturing conditions than would normally be required. This may permit false twist texturing, for example, to be performed on hard fiber which is then fed directly into the entangling step in a single continuous process.

There should be at least five hard fiber filaments, a smaller number being insufficient to form a useful degree of entanglement and random braiding. More filaments are generally desirable to provide more chances for entanglement, and more thorough protection for the elastic yarn. Low denier per filament in the hard fiber yarn is generally conducive to better entanglement, the smaller filaments being more easily formed into a random braid. In the case of stretch textured or bicomponent yarns, low denier per filament favors formation of small, fine coils when relaxed. Low bending modulus in the hard fiber filaments is also conducive to improved entanglement. A yarn with residual torque force, such as a yarn produced by one of the numerous ways of texturizing, often will form a twisted loop (e.g., at 24 in FIG. 5) during finishing of fabrics. The twisted loop gives a softer tactile hand to a fabric surface because it is more compliant and flexible than loops of horseshoe, arched (e.g., at 20 and 23 in FIG. 5) or circular shapes.

The hard fiber feed yarns should have low twist, preferably not more than the 0.2 to 0.5 turns per inch known as "producer twist," or most preferably zero twist. High twist interferes with opening of the filament bundle during the process of entangling and surrounding the elastic core. Feed yarns having zero or low twist may have interlace as described in Bunting et al. U.S. Pat. No. 2,985,995, but they should not have such a large degree of interlace that the filaments are unable to separate for random braiding in the present process. For the present purposes, a yarn having the lowest degree of interlace consistent with processing, winding, and unwinding is preferred, no interlace being most preferable.

The yarns should not have size or finish of such a cohesive nature that is prevents the bundle from opening during the entangling process, although certain finishes may be desirable which allow the bundle to open but aid in retaining entanglement subsequently. Finishes disclosed in Gray U.S. Pat. No. 3,701,248, for example, may be used to improve the performance of yarns of this invention.

The hard fiber filaments, at the time they enter the entangling operation along with the stretched elastic yarn, must be fed at no more than about 2% net overfeed or underfeed. The term "net" indicates the overfeed or underfeed after any shortening or lengthening of the yarn has taken place due to previous treatments which the yarn has received, such as stretching, or due to any additional effects which may take place in the entangling zone. For example, the hard fiber yarn may be stretched before entering the entangling zone due to combining the operation of the present invention with the drawing operation on the hard fiber yarn. When the yarn is at drawing tension before entering the entangling zone, an elastic retraction of 5 to 10% or more may take place depending on the nature of the polymer and the drawing conditions. Furthermore, certain types of textured or crimped yarns may be stretched before entangling to remove visible crimp or to enhance the development of latent crimp. Such stretching will result in a certain degree of elastic retraction as the yarn goes from the higher tension to the low tension required for entangling. On the other hand, if the hard fiber yarn either shrinks or elongates in the entangling zone for any other reason, such as the use of elevated temperature in the jet, or the effect of liquids applied to the covering yarn, such changes in length should be taken into account in determining the true net overfeed.

If net overfeed of appreciably greater than 2% is used during the entangling operation, the hard fiber filaments form loops and tangles which tend to persist even if the tension is raised before the yarn is put on a package. Such persistent loops project from the surface of the package and snag the yarn as it is leaving the package, producing tension plucks. On the other hand, appreciable underfeed or high tension on the hard fiber filaments will inhibit their ability to open up satisfactorily and entangle about the elastic core. The net underfeed should be no more than about 2%.

The fluid jet entangling device may be one of those shown in Bunting el al. U.S. Pat. Nos. 3,364,537 and 3,115,691 or McCutchan U.S. Pat. No. 3,426,406, for example, in which one or more fluid streams impinge on the yarn line at an angle of 90° ± 45°. The essential requirement is that the hard fiber filaments be subjected to a fluid stream having an appreciable component of force at right angles to the filaments to separate them and force them around the elastic yarn and around and between other hard fiber filaments to entangle the hard fiber filaments by a random braiding action intermittently along the length of the composite yarn. If fluid jets are directed at the yarns at an angle of less than 45°, the fluid forces parallel to the yarns tend to be greater than those transverse to the yarns, thereby tensioning the filaments and tending to form stable loops rather than braiding them. It is also necessary to avoid a predominantly unidirectional fluid twisting vortex since such action tends to wrap the filaments around the yarn rather than randomly braiding them. Jets having a unidirectional twisting effect are suitable for the present process only when a yarn oscillates rapidly between a region of fluid torque operating in one direction and a region of opposite torque, as in Bunting et al. U.S. Pat. No. 2,990,671.

For most purposes, yarns of this invention should be wound on a package at a tension not appreciably less than that employed during the entangling operation. If a lower tension is employed, the retraction of the elastic yarn will force the hard fiber filaments to bulge out and protrude from the surface of the package. When yarn is removed from the package, the protruding filament loops will snag the yarn coming off the package and produce tension plucks in the yarn, which will impair the feeding of the yarn into the knitting or weaving operation and will degrade the fabric quality. This is particularly true of light denier leg yarns for circular knitting of hosiery. However, certain heavy denier yarns for outerwear may be wound at substantial relaxation because the fabric-making operations can tolerate more tension non-uniformities coming off the package and the yarns are not appreciably degraded by moderate snagging. In some cases, the winding tension may be higher than that employed during the entangling operation. This may be particularly true of very light denier yarns where the elastic yarn is 20 denier or less.

When more than one elastic filament or coalesced multifilament is used, the fluid forces transverse to the yarns insert portions of the hard fiber filaments between the core elements, thus anchoring the hard fiber filaments to the elastic yarns. This effect is in addition to the cohesion contributed by the entanglement of other of the hard fiber filaments around the multiple elastic yarns. Such entanglement, in turn, improves the anchoring of the hard fiber filaments, which are between or amongst the elastic core elements, by holding such elements together to prevent the hard fiber filaments from pulling out from between the elastic yarns.

If desired, a composite yarn may be run through a second jet where an additional hard fiber yarn may be applied over the first, the tension and overfeed requirements for the second yarn being similar to the first. Alternatively, a composite yarn of this invention may be wrapped with a hard fiber yarn in a normal single covering operation, yielding a product which can replace double covered yarn at reduced cost.

A remarkable advantage of this process is that it may be operated at speeds of 10 times to 100 times that of a conventional covering process. For example, the conventional yarn speeds in single covering are 15–25 yards per minute where 20–30 turns of twist per extended inch of yarn required for adequate protection. In double covering, speeds are 5–10 yards per minute. The process of the present invention may be operated at speeds of up to 800 yards per minute or higher, including speeds which permit spinning, drawing and entangling in a single continuous process.

Product

The yarn of this invention comprises one or more elastic yarns (or filaments) and continuous hard fiber filaments entangled intermittently about the elastic yarn in a random braided structure, and when the composite yarn is stretched until the hard fiber filaments first become load-bearing, is substantially free of crunodal or other surface loops. The randomly braided zones usually occur at discrete intervals along the length of the composite yarn but in some cases the entanglement may be intense, particularly when the hard fiber yarn consists of a large number of fine denier filaments.

The braiding is said to be random and intermittent because filaments do not pass over and under adjacent filaments in a uniform pattern as in a true braid, but rather a portion of a filament will pass under another and entangle with it, forming entanglements of opposite hand at irregular locations along the length of the yarn.

The random braided structure simulates the action of a tubular braided structure. When such a structure is elongated axially, it contracts radially and vice versa. Devices operating on this principle are used for gripping objects to be lifted and for pulling electrical cables through conduits.

The random intermittent braided structure of this invention has important advantages over other ways of protecting an elastic yarn. For example, when a single covered yarn of the prior art is stretched to the point at which the covering yarn bears the majority of the tensile load, the covering yarn tends to follow a straight axial path while the elastic core spirals about the covering yarn. Under such conditions, the elastic yarn can no longer be said to be "covered," and the elastic yarn is forced out against yarn guides or knitting machine parts, for example, where its high friction impedes feeding of the yarn. When composite yarn of the present invention is tensioned to a similar extent, it is found that hard fiber filaments are entangled completely around the elastic yarn at frequent intervals so that the entire periphery of the elastic core yarn is protected by hard fiber filaments at such zones. Furthermore, at least a few hard fiber filaments are randomly distributed about the elastic yarn between such zones, furnishing substantial protection to the elastic yarn between the zones. Thus, the hard fiber filaments in yarns of this invention may protect the elastic yarn best at tensions sufficient to destroy the "covering" mechanism of single covered yarns. Therefore, yarns of the present invention should preferably be wound, unwound, knit or woven at tensions sufficient to load the hard fiber filaments. A particular retractive power or stretch ratio of the elastic yarn may be selected to accomplish this goal in a yarn intended for a particular end use.

In addition, when high tension is needed to pull the composite yarn through weaving or knitting machinery, the randomly-braided structure grips the elastic yarn and tightens on it at each randomly braided zone. In single covered yarn, the covering is not attached to the core at any point. One difference between a yarn of this invention and single covered yarn can be shown dramatically by cutting the hard fiber filaments of each. In single covered yarn, the covering will simply unwind and separate from the core. In yarns of this invention, the hard fiber filaments will remain entangled about the core. Such coherency is accomplished without the need for fusing covering filaments to the core.

A further advantage of the random intermittent braided structure is seen when the composite yarn is relaxed. Portions of the hard fiber filaments are free to loop, bend away from the elastic yarn or develop crimp, thus contributing bulk, covering power, and spun-like tactile aesthetics to the product. Even at the points of most intense random braiding, the axial retraction of the elastic core permits the structure to expand. This is in contrast, for example, to the behavior of yarns covered by a wrapping process wherein the turns of wrapping become tighter as the expansion of the elastic yarn presses outward against the wrappings to limit the degree of contraction. The hard fiber filaments in yarns of this invention have greater freedom to depart from the elastic core than do the filaments of a single covered yarn where the entire covering yarn passes frequently around the elastic yarn. This is particularly true in yarns of this invention in the regions between zones of maximum entanglement, where the hard fiber filaments have little entanglement and are almost completely free when relaxed. Therefore, the filaments of the hard fiber yarn are more nearly free to exhibit their own individual character, and so may display a much wider variety of properties than those made by other processes. In contrast, the prior art processes of twisting, false twisting, or otherwise wrapping hard fiber filaments about an elastic yarn limit the character of the composite yarns to those imposed by the particular covering process regardless of what type of hard fiber yarn is used.

Surprisingly, hosiery fabrics made from yarns of this invention which are only intermittently surrounded by hard fiber have wear durability equivalent to those made from single covered yarns which are continuously wrapped in a spiral manner.

Since a composite yarn of the present invention has not been heated during the combining process, the elastic portion shows no evidence of heat-set crimp, twist, or torque, and its elongation and retractive power are substantially the same as before combining. The yarns of this invention are essentially torque-free since there are no substantial zones in which the hard fiber filaments are wrapped unidirectionally around the elastic yarn.

UTILITY

Yarns of the present invention may in general be used in fabrics which employ single or double covered yarns such as the leg and top of pantyhose, the elastic top of men's hosiery, and knitted waistbands. Most of such fabrics are circular knit.

They are also useful in stretch warp-knit fabrics made on tricot or raschel machines. In one method of operation, 100% nylon filament yarns are knit on one bar of the machine, and the composite yarn is knit on the other. Because the hard fiber filaments of the composite are relatively lightly associated with the elastic yarn, when knitting tensions are released they form numerous loops which have enough freedom to come to the surface of the fabric. The number, spacing, size and shape of the loops will depend on the type of hard fiber used. This development of loops can affect fabric hand and surface texture in profound ways which cannot be duplicated if the hard fiber filaments are bound closely to the spandex in a "single covered" yarn. Increasing the number of loops formed also provides bulk which improves fabric body and fullness.

The particular fabric character and aesthetics will depend on the geometry and openness of its contruction. The yarn knit on the front bar generally appears on the surfaces of the fabric. Putting the composite on this bar therefore gives the most pronounced surface effects. Depending on the stitch pattern, the hard fiber filaments of the composite can be brought to one or both surfaces of the goods.

Optionally, the composite yarns may be knit on the back bar. Although this typically carries them to the fabric interior, the inelastic component may appear at the surfaces if the back bar yarn is "laid in" to the construction, that is, if it passes through the front bar stitches rather than forming stitches itself. Alternatively, the composite yarn may be intermittently knit and laid in, e.g., knit on one course and laid in on one or more courses before repeating the knit course. When the composite yarn is laid in, the longer the segments between its passages around needles, the greater its freedom to form projecting loops of hard fiber filaments.

The resulting surface texture can range from a soft and velvety nap to nubby or pebbled effects, depending on the size, stiffness and shape of the loops. A fine spun-like surface may be obtained most readily when the inelastic component is a textured yarn, because the individual loops twist on themselves to form flexible nearly-linear "hairs" (FIG. 5, 24) on the fabric surface.

A loop-pile surface results when non-textured hard fiber filaments are used. These loops do not twist on themselves. They may be sheared or broken by abrasives in the conventional ways to make surface pile, as in sueding. Depending on the number and size of the loops, the resulting surface will be spun-like, sueded, velour or heavily napped. When the hard fiber portion of the composite yarn has high shrinkage or latent crimp, as in bicomponent yarns, a more compacted nap is formed at one or both fabric surfaces.

The above effects are useful and have value for stretch dresses, blouses, swim suits, and other uses, because they provide the surface characteristics obtained from spun yarns. Spun-like aesthetics are especially desirable for apparel but are difficult to obtain by warp knitting techniques. The new products also afford versatility in using the simple fabrication procedure of two-bar warp knitting. Unique textures and fabric surface interest are possible which can be approached only by more expensive multi-bar knitting or weft insertion procedures.

The principles described above apply in the same way to stretch fabrics made by weft knitting and by weaving, where the new composite yarns also afford novel and useful products, such as crepe fabrics.

Certain varieties of products of this invention may be used in the legs of ladies' hosiery where sheerness is desired. A yarn of this invention, employing bicomponent filaments as the hard fiber, provides retractive and support power equal to a single covered yarn and also valuable sheerness.

Yarns of the present invention can be taken off packages and fed into weaving or knitting operations with processability as good as that of single covered yarn where similar elastic and hard fiber yarns are employed. Where the hard fiber has a large number of filaments, the processability of double covered yarn can be approached. Furthermore, the low or zero degree of torque in yarns of this invention makes them suitable for use in applications where the torque in single covered yarn would present problems.

Test Procedures

Hosiery Knitting Efficiency

This term expresses the hours of actual knitting time of a given yarn or yarns on commercial hosiery knitting machines, as a percentage of the total elapsed hours during which the test was conducted. To ensure validity of comparisons of knitting efficiencies among different yarns, the machines are given comparable surveillance and attention so that the down-time per break is comparable. Periodic inspections ensure that the yarns to be compared are giving first-grade hosiery.

Delivery And Residual Tension Measurement

Delivery tensions of less than 5 grams at about 200 ypm are generally considered necessary for acceptable commercial pantyhose knitting performance. Higher tensions result in unacceptably frequent yarn breaks and knitting interruptions. It is also necessary that the tension in the yarn drops immediately to less than 4 grams when knitting stops. If the yarn tension remains high, the yarn will pull back from the binder holding the idle end and knitting cannot be resumed without restringing the machine.

Figure 9:
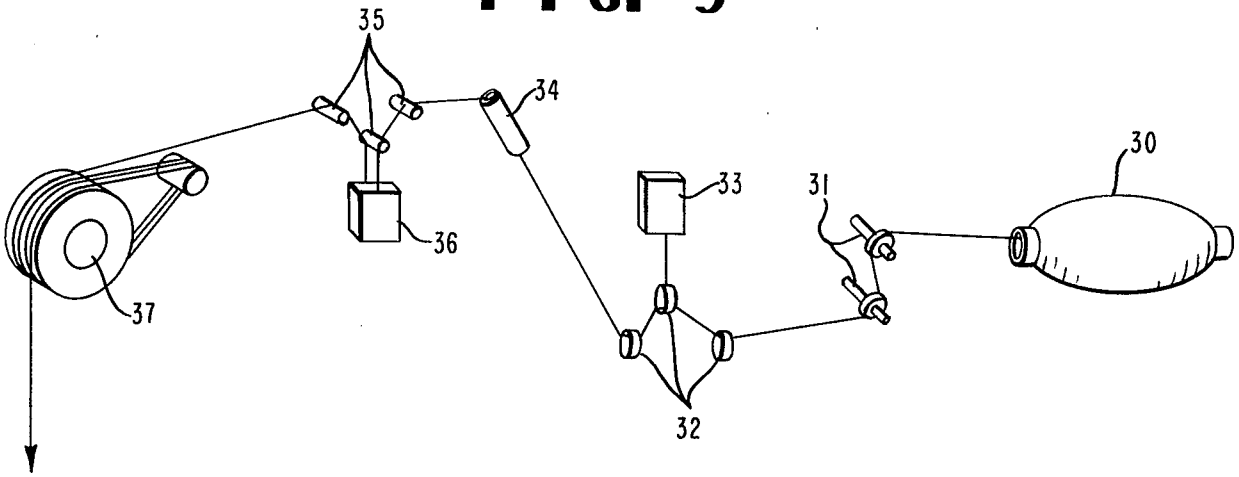
FIG. 9 is a schematic representation of equipment for measuring yarn delivery and residual tensions.

A laboratory device simulating the knitting machine threadline path is used to determine both the delivery tension and the residual tension of test yarn (FIG. 9). Yarn is withdrawn from the test package 30 at 200 ypm. The yarn passes in an S fashion around two 3/16 inch diameter smooth Alsimag snubbing pins 31 arranged on one inch centers. Total wrap angle through these pins is about 180°. The yarn then passes through three ceramic eyelets 32 arranged so that a 60° wrap angle was made on the middle eyelet which is connected to strain gauge 33 and a device (not shown) for recording the delivery tension of the yarn being drawn from the pirn. The yarn then passes straight into hollow Alsimag feed finger tube 34 (obtained from a knitting machine) with an inside diameter of 0.03 inch and length of 0.75 inch. The yarn bends at 60° when leaving the tube. The yarn then passes through a second tension measuring device having three pins 35 and strain gauge 36 and thence to the puller roll 37. Residual tension is measured by the second tension measuring device attached to strain gauge 36 five seconds after stopping the puller roll.

Method Of Determining Whether A Yarn Is Of This Invention

1. Strip surface yarn from package until fresh yarn is exposed. Grasp yarn near surface of package and remove approximately one foot of yarn, maintaining approximately the tension at which the yarn was wound on the package. If the yarn was not wound on the package at a tension sufficient to load the hard fiber, the yarn should be tensioned until the hard fibers just bear tensile load.

2. The one-foot length of yarn should be examined with a magnifying glass or microscope. If crunodal filament loops project from the yarn surface, the yarn is not of this invention. The yarn should also be observed for the presence or absence of entanglements similar to those shown at 21 and 22 on FIGS. 3 and 4. If the hard fiber filaments are everywhere approximately parallel to each other, either in a spirally twisted configuration or parallel to the composite yarn axis, the yarn is not of this invention.

3. A section of yarn several inches long when relaxed is cut from the package and the hard filaments are removed. If the relaxed elastic yarn is crimped or convoluted, the yarn is not of this invention. In a yarn of this invention, the elastic portion will be substantially straight when relaxed.

4. Take a new one-foot length of composite yarn and remove any true twist which may be present in it.

5. While the composite yarn is relaxed, grasp the hard fiber filaments at the point where they appear to be least bound to the elastic yarn and pull transversely to separate all hard fiber filaments from the elastic yarn. Insert a probe one centimeter in diameter between the hard fiber filaments and the elastic yarn. Tension the yarn until the hard fiber filaments just bear a tensile load. Measure the distance between the points at which the hard fiber filaments join the elastic yarn. Repeat the measurement on 5 sections of one foot extended length each and average the readings of the 5 sections. If the average entanglement spacing is less than 10 centimeters, the yarn is of this invention.

Entanglement Coherency Test

An automatic yarn entanglement tester, Model R-2040, manufactured by Rothschild, is used for determining coherency of the composite bundle. The equipment is substantially as described in Bulla et al. U.S.

Pat. No. 3,566,683, FIG. 7, and Column 5, line 37 through Column 6, line 6. The running tension is determined by the setting of hysteresis brakes 6'. An entanglement is indicated by a rise in tension from the level of the running tension to the predetermined tension sensed by load cell 92. A short distance indicates high entanglement. If the piercing needle misses the yarn bundle, the yarn is advanced for a predetermined length of 40 centimeters and such a measurement is automatically rejected. On each sample of yarn, the device inserts the needle 10 times and prints the total distance between stops with the needle inserted in the yarn. Three sets of 10 measurements each are taken on each yarn sample and the results are averaged. Tension settings to be used for the entanglement test on composite yarns having various nominal deniers of elastic component are shown in Table I.

TABLE I

| Denier of Elastic Yarn | Running Tension | | Predetermined Tension | |
|---|---|---|---|---|
| 10–39 | 15 | gms. | 23 | gms. |
| 40–69 | 20 | | 30 | |
| 70–99 | 35 | | 45 | |
| 100 and over | 75 | | 95 | |

In the following examples, entangling jet 9 shown in FIG. 2 has orifices 18 of 0.876 millimeters diameter, and included angle between orifices 18 is 90 degrees, and the distance between the orifices where they emerge from the lower surface of body 17 is 3.94 millimeters. The distance between wall 19 and body 17 is 1.18 millimeters. Since the plane of the cross section A—A is perpendicular to the yarn 10 each of orifices 18 impinges on yarn 10 at 90° to the axis of the yarn. The measurement of "Elongation to Break" begins with the yarn extended under a load of 0.3 grams.

EXAMPLE I

A 20 denier seven filament false-twist-textured polyhexamethyleneadipamide stretch yarn is combined with a 40 denier coalesced spandex elastic yarn in the manner indicated in FIGS. 1 and 2. The nylon is snubbed to provide a tension of 10 g ahead of the roll 4 which is rotating with a surface speed of 789 ypm. The elastic yarn is unwound by a rolling take-off at 197 ypm providing a 4X stretch between feed roll 3 and draw roll 4. Five wraps are taken around rolls 4 and 8. Both yarns are passed through the entangling jet 9 operating at an air pressure of 60 psig and then four more wraps are taken on a 4% smaller step on the same rolls. Retraction of the nylon from the prestretching caused by the 10 g. tension is sufficient to provide a 0% net overfeed in the jet zone. Yarn is wound on package 11 with a ring and a traveler, with the nylon filaments under tension and with 0.3 turns of twist/inch in the final yarn. The packaged yarn is 33% spandex and 67% nylon.

The resultant yarn of this invention is knit into pantyhose tops at 80% efficiency vs. 75–85% for single covered yarn knit on the same equipment. Panythose appearance and fit are essentially equivalent to those obtained from single or double covered yarn. The composite yarn has 240% elongation to break. Entanglement as measured with the Rothschild Entanglement Tester, Model R-2040 is 2.0 cm. Delivery tension from the package is 1.6 g to 3.8 g. Residual tension in the threadline five seconds after stopping is 1.3 g to 3.0 g.

The flase-twist-textured nylon yarn has substantial torque when removed from the package and measured by usual methods for determining torque. However, the entangling operation for making the composite yarn of the invention rearranges the filaments so that torque in individual filaments do not necessarily reinforce one another and therefore the torque in the final composite yarn is substantially less than that in the original feed yarn, and is sufficiently low that no adverse effects are seen in the knitting operation or in the resulting fabric. There is no need to knit S and Z torque yarns in any particular pattern.

The same yarns are combined as stated earlier but with a five percent net nylon overfeed in the jet zone. The resultant composite yarn (not of this invention) is tightly entangled (Entanglement measurement, 0.74 cm.) but has small nylon filament loops when tensioned and wound on a package. These interfere with delivery of the yarn from the pirn and with knitting. Delivery tension of this type of yarn is 3.6 g and residual tension is 3.9 g. Knitting efficiency in pantyhose tops is much less than 50% even with pirns hanging in an inconvenient inverted position and with yarn being removed from the lower end to assist in take-off. Knitting performance is rated commercially unacceptable.

The same yarns are combined as stated earlier except at 341 ypm. and with a 5% net nylon underfeed. The resultant yarn (not of this invention) has poor coherency and little entanglement of the hard fiber filaments. The two components separated easily when removed from the package and the composite yarn does not knit acceptably. Entanglement as measured by the Rothschild Entanglement Tester is 9.4 cm. Delivery tension is 4.6 g and residual tension is 3.0 g.

EXAMPLE II

Composite yarn of this invention of Example I is wound on a set of tricot beams at 28 ends per inch at a tension of 11 to 12 grams/end. At this tension the nylon hard fiber component supports the load and does not loop out from the threadline. These beams are threaded to the back bar (BB) of a Mayer 28-gauge tricot knitting frame. Beamed 40-denier 13-filament nylon is threaded to the front bar (FB). Tricot is knit at 500 stitches/minute in constructions A and B as shown in Table II. The beaming arrangement is then reversed for fabric C by using the beams of composite yarn for the front bar and the 40–13 nylon for the back bar. All fabrics are then fully relaxed by boiling in water for 15 minutes and tumble drying at 140° F. The available stretch in each direction is determined by hand and is tabulated in Table II. Samples are mounted on tenter frames to stabilize them by heat setting. They are mounted just taut in any direction where available stretch is below 75% otherwise extended far enough to provide 75% residual hand stretch after setting. Heating is carried out for 25 to 40 seconds at 382°–385° F. after which the samples are acid dyed at pH 4.5 to 5.5 for 15 minutes, rinsed and dried at room temperature.

After finishing, Sample A has a dry hand, suggesting the feel that fine cotton would give, whereas analogous tricot from bare 40 denier spandex and nylon feels flat and smooth. At low magnification, the difference can be seen to stem from the nylon projecting more strongly from the fabric surfaces of Sample A. The interior of the fabric is crowded with small loops of the textured nylon. Their bulk alters the contours of the yarn at the surfaces of the tricot.

The surfaces of Sample B feel soft to the touch, as if covered by down. Magnification shows that twisted loops of the textured nylon filaments project from both sides of the fabric. In this construction, "laying in" the composite yarn means that it does not form stitches and so is freer to develop loops at the fabric surfaces.

Freedom of the composite yarn to develop surface loops during finishing is even greater in the construction of Sample C. A heavy nap covers the fabric on the lap side, creating a soft velour-like texture adaptable to stretch outerwear. Magnification shows the napped surface to be populated heavily by small loops of the textured nylon.

TABLE II

| SAMPLE | CONSTRUCTION | RUNNER LENGTH | INCHES OF FABRIC PER 480 COURSES | HAND STRETCH LENGTH | HAND STRETCH WIDTH |
|---|---|---|---|---|---|
| | | inches | (quality) | % | % |
| A | Jersey FB 2-3/1-0 | 63 | 7.75 | 103 | 135 |
| | BB 1-0/1-2 | 36 | | | |
| B | Atlas Fb 2-3/2-1/1-0/1-2 | 51 | 11 | 130 | 115 |
| | Lay-in alternate courses | 45 | | | |
| | BB 1-0/1-1/2-3/2-2 | | | | |
| C | Jersey FB 2-3/1-0 | 85 | 8 | 70 | 130 |
| | BB 1-0/1-2 | 44 | | | |

EXAMPLE III

A 20 denier fourteen filament false-twist-textured stretch polyhexamethyleneadipamide yarn is combined with a 40 denier coalesced spandex elastic yarn in the manner indicated in FIGS. 1 and 2. The nylon is snubbed to provide a tension of 0.5 to 1.0 gram ahead of draw roll 4 which is rotating at a surface speed of 341 ypm. The elastic yarn is unwound by a rolling take-off at 85.5 ypm providing a 4X stretch between feed roll 3 and draw roll 4. Two wraps are taken around rolls 4 and 8. Both yarns are passed through entangling jet 9 at 60 psig air pressure and then two more wraps are taken on the same rolls at the original diameter to provide essentially 0% overfeed of the nylon in the jet zone. Yarn is wound on package 11 with a ring and traveler, with the nylon filaments under tension and with 0.3 turns of twist/inch in the final yarn. Yarn as packaged is 33% spandex and 67% nylon.

The resultant composite yarn is knit into pantyhose tops. Pantyhose appearance, fit and durability are essentially equivalent to those made from single covered yarn. The composite yarn has 333% elongation to break. Entanglement as measured with the Rothschild Entanglement Tester, Model R-2040 is 1.7 cm. Delivery tension from the packages is 2.6 gms., and residual tension in the yarn five seconds after stopping is 2.6 gms.

EXAMPLE IV

A 20 denier seven filament false-twist-textured polyhexamethyleneadipamide stretch yarn is combined with a 55 denier elastic yarn comprising two separately-coalesced spandex elastic yarns of 27.5 denier each in the manner indicated in FIGS. 1 and 2. The nylon is snubbed to provide a tension of 0.5 to 1.0 g ahead of draw roll 5 which is rotating at a surface speed of 789 ypm. The elastic yarn is unwound by a rolling take-off at 197 ypm provided a 4X stretch between feed roll 3 and draw roll 4. Three wraps are taken around rolls 4 and 8. Both yarns are passed through entanglement jet 9 at 95 psig air pressure and then two more wraps are taken on the same rolls to provide a 0% net overfeed of the nylon in the jet zone. Yarn is wound on package 11 with a ring and traveler, with the nylon filaments under tension, and with 0.3 turns of twist/inch in the final yarn. Yarn as packaged is 41% spandex and 59% nylon.

The composite yarn is knit into pantyhose tops which have cotton-like feel and substantial opacity at 92% efficiency. Pantyhose fit and durability are essentially equivalent to those obtained with single covering yarn. The composite yarn has 300% elongation to break. Entanglement is 1.3 cm. Delivery tension from the package is 3.0 g. Residual tension in the threadline five seconds after stopping is 1.7 g. yarn as packaged is 41% spandex and 59% nylon.

The coherency of this yarn using two spandex elastic yarns is better than that of a yarn made by a similar process but using one 55 denier coalesced spandex elastic yarn. The latter has an entanglement of 1.5 cm., delivery tension of 2.5 gm. and residual tension of 3.2 gms., substantially higher than the data for the previous yarn. The poorer coherency of the latter is also seen in slight defects caused by sliding of the nylon along the elastic yarn, about 15 per hose, while hose made from composite yarn having two spandex yarns has only about 5 defects per hose. The sliding is caused by the fact that the tension used in knitting these yarns is lower than the tension at which the yarn was entangled and wound on the package, and therefore the hard fiber yarn is somewhat loose on the elastic yarn when passing through the knitting equipment.

EXAMPLE V

A 20 denier twelve filament bicomponent polyamide yarn is combined in the manner indicated in FIGS. 1 and 2 with a 55 denier elastic yarn made of two 27.5 denier separately coalesced ends. The nylon is snubbed to provide a tension of 0.5 to 1.0 g ahead of draw roll 4 which rotates with a surface speed of 341 ypm. The elastic yarn is unwound by a rolling take-off at 85.5 ypm providing a 4.0X stretch between feel roll 3 and draw roll 4. Two wraps are taken around rolls 4 and 8. Both yarns are passed through entangling het 9 at 100 psig air pressure and then two more wraps are taken on the same rolls to provide a 0% net overfeed in the jet zone. Yarn is wound on package 11 with a ring and traveler, with the nylon filaments under tension and with 0.3 turns of twist/inch in the final yarn. Yarn as packaged is 41% spandex and 59% nylon.

The composite yarn had 323% elongation to break. Entanglement is 1.2 cm. Delivery tension from the package is 4.7 g. Residual tension in the threadline five seconds after stopping is 2.2 g.

Pantyhose legs are knit using the composite yarn in alternate courses with 21-denier 3 filament type 280 regular nylon yarn. Subsequent development of the crimp in the latently crimpable bicomponent yarn during scouring, dyeing, and boarding results in a unique fabric structure with unexpected sheerness. Since the elastic yarn supports the fabric load, the balanced torque bicomponent yarn crimps in tight association and in the same yarn path as the elastic yarn, resulting in the surprising sheerness.

Pantyhose in which the legs are made as described above are evaluated for durability by weartest versus commercial pantyhose of comparable size, stretch and sheerness. The legs of the commerical hose are knit from 40-denier spandex yarn, single-covered at 30 turns per inch with 20-7 nylon, with alternate courses of 21-3 nylon. The two types of garments have equivalent wearlife in their leg portions. For example, of 14 pair of single-covered hose starting the test, 7 pair were still being worn on the tenth day. The others had been rejected by the wearers because of failures in the leg. When the surviving 7 pair were inspected by test referees, only 3 were judged suitable for continued wear, because of significant or incipient damage. On the other hand, of 9 pair of composite-yarn hose at the start, five were being worn on the tenth day, four of which were judged acceptable for resumed use. In view of the vagaries of this type of testing, these results are considered equivalent. The conclusion of comparable durability of these hosiery fabrics is supported by laboratory data in which test hosiery legs are rubbed until failure between polymethacrylate and nylon-belt surfaces under controlled conditions.

EXAMPLE VI

A 70 denier thirty-four filament untextured polyhexamethyleneadipamide yarn with trilobal cross-section filaments and no interlace or twist is combined with a 40 denier coalesced spandex elastic yarn in the manner indicated in FIGS. 1 and 2. The nylon is snubbed to provide a tension of about 1.0 g ahead of draw roll 4 which rotates with a surface speed of 341 ypm. The elastic yarn is unwound by a rolling take-off at 85.5 ypm providing a 4.0X stretch between feed roll 3 and draw roll 4. Two wraps are taken around rolls 4 and 8. Both yarns are passed through entangling jet 9 operating at 100 psig air pressure and then two more wraps are taken on the same rolls to provide a 0% net overfeed of the nylon in the jet zone. Yarn is wound on package 11 with a ring and traveler, with the nylon filaments under tension and with 0.3 turns of twist/inch in the final yarn. The final yarn is 12.5% spandex and 87.5% nylon.

The composite yarn has 223% elongation to break. Entanglement is 1.3 cm.

The above yarn is wound on quills at a tension of 18 grams which prevents the nylon component from looping out, and is woven at the same tension in the filling of a fabric using a 58-inch wide warp of 70-34 nylon. The loomed construction is a plain weave of 58 ends per inch and 80 picks per inch. The resulting fabric is scoured in a beck at 140° F and acid dyed at pH 4 for 90 minutes at 200° F after which it has retracted to a width of 23 inches. It is stabilized by heat setting at 42-inch width on a tenter frame at 380° F for 1 minute.

Suprisingly, the relaxed finished fabric, 39-inches wide with 25% available stretch, is a crepe. Its surface is covered with a network of permanent fine crinkles in the length direction. A comparable woven stretch fabric with filling of 40-denier spandex which has been single-covered with 70-34 nylon, has a flat non-crepe surface.

EXAMPLE VII

A 20 denier seven filament false-twist-textured polyhexamethyleneadipamide stretch yarn is combined with two ends of 35 denier separately-coalesced spandex elastic yarn in the manner indicated in FIGS. 1 and 2. The nylon is snubbed to provide a tension of 0.5 to 1.0 gram ahead of draw roll 4 which rotates at a surface speed of 341 ypm. The elastic yarn is unwound by a rolling take-off at 85.5 ypm providing a 4X stretch between feed roll 3 and draw roll 4. Two wraps are taken around rolls 4 and 8. Both yarns are passed through entangling jet 9 at 100 psig air pressure and then two more wraps are taken on rolls 4 and 8 at the original diameter to provide 0% net overfeed in the jet zone. Yarn is wound on package 11 with a ring and traveler, with the nylon filaments tension and with 0.3 turns of twist/inch in the final yarn. Yarn as packaged is 47% spandex and 53% nylon.

The composite yarn has 325% elongation to break. Entanglement is 1.6 cm. Delivery tension from the package is 1.9. Residual tension in the threadline five seconds after stopping is 2.2 g. The composite yarn is knit into pantyhose tops at about 90% efficiency in a mill test vs. 75-85% for single covered yarn. Pantyhose appearance, fit and durability are essentially equivalent to those obtained with single covered yarn.

I claim:

1. A composite yarn comprising uncrimped elastic yarn and at least five synthetic filaments of relatively inelastic material to protect the elastic yarn and provide desirable textile properties, the relaxed composite yarn being bulky and capable of being extended at least 100 percent in length when stretched until the relatively inelastic filaments first become load-bearing; said stretched composite yarn being characterized by load-bearing relatively inelastic filaments entangled tightly around the elastic yarn in intermittent zones of random braided structure and otherwise extending substantially parallel to the elastic yarn, there being an average entanglement spacing of less than 10 centimeters and said filaments being essentially free from crunodal or other surface loops when the composite yarn is in said strecthed condition.

2. A composite yarn as defined in claim 1 which has substantially zero unidirectional torque.

3. A composite yarn as defined in claim 1 wherein said relatively inelastic filaments have crimp when relaxed.

4. A composite yarn as defined in claim 1 wherein said relatively inelastic filaments form loops and twist pigtails when the composite yarn is relaxed.

5. A composite yarn as defined in claim 1 wherein said relatively inelastic filaments form reversing helical coils when the composite yarn is relaxed.

6. A composite yarn as defined in claim 1 wherein said relatively inelastic filaments are bicomponent filaments which crimp when relaxed.

7. A composite yarn as defined in claim 1 wherein said elastic yarn is coalesced spandex elastic yarn having a break elongation greater than 200 percent.

8. A composite yarn as defined in claim 1 wherein said elastic yarn is composed of a plurality of spandex elastic filaments.

9. A composite yarn as defined in claim 1 which has a break elongation of 200 to 400 percent.

10. A composite yarn as defined in claim 1 wherein the average entanglement coherency is less than 5 centimeters.

11. A composite yarn as defined in claim 1 wherein the yarn is on a package and the relatively inelastic filaments are under tension.

12. A process for combining elastic yarn, having a break elongation of greater than 100 percent, with relatively inelastic synthetic polymer filaments to produce a composite yarn, which comprises continuously feeding the elastic yarn with the relatively inelastic filaments through jetted high velocity fluid and impinging the jetted fluid on the yarn axis at an angle of 90° ± 45° to separate the filaments and entangle the filaments tightly around the elastic yarn in intermittent zones of random braided structure, the elastic yarn being fed under tension sufficient to extend the yarn to at least 100 percent greater length than its relaxed length, and the relatively inelastic filaments being fed at a rate which provides between 2 percent net underfeed and 2 percent net overfeed to the jetted fluid.

13. The process defined in claim 12 wherein the elastic yarn is composed of coalesced spandex elastic yarn having a break elongation of greater than 200 percent and the yarn is fed under tension sufficient to extend the yarn to at least 200 percent greater length than its relaxed length.

14. The process defined in claim 13 wherein the elastic yarn is composed of a plurality of separatelycoalesced spandex elastic yarns and the jetted fluid is impinged on the elastic yarn to insert portions of said relatively inelastic filaments between the spandex yarns in addition to entangling the filaments around the elastic yarn.

15. The procss as defined in claim 12 wherein the jetted fluid is impinged on the yarn from more than one direction, each substantially perpendicular to the yarn axis.

16. The process as defined in claim 12 wherein the composite yarn is wound on a package with the relatively inelastic filaments under tension.

* * * * *